US009874078B2

(12) United States Patent
Knapp

(10) Patent No.: US 9,874,078 B2
(45) Date of Patent: Jan. 23, 2018

(54) BOLTLESS ELECTRICAL CONNECTOR FOR SUBMERSIBLE WELL PUMP

(71) Applicant: Baker Hughes Incorporated, Houston, TX (US)

(72) Inventor: John M. Knapp, Claremore, OK (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 450 days.

(21) Appl. No.: 14/598,400

(22) Filed: Jan. 16, 2015

(65) Prior Publication Data

US 2016/0208806 A1 Jul. 21, 2016

(51) Int. Cl.

| | |
|---|---|
| ***F04B 35/04*** | (2006.01) |
| ***E21B 43/12*** | (2006.01) |
| ***F04D 13/08*** | (2006.01) |
| ***F04D 13/10*** | (2006.01) |
| ***F04D 13/06*** | (2006.01) |
| ***E21B 17/02*** | (2006.01) |

(52) U.S. Cl.

CPC ..... *E21B 43/128* (2013.01); *E21B 17/028* (2013.01); *F04D 13/0693* (2013.01); *F04D 13/08* (2013.01); *F04D 13/10* (2013.01)

(58) Field of Classification Search

CPC .. E21B 43/128; E21B 17/028; F04D 13/0693; F04D 13/10; F04D 13/08; Y10T 403/7075

USPC ..... 439/259, 347

See application file for complete search history.

(56) References Cited

U.S. PATENT DOCUMENTS

| | | | | |
|---|---|---|---|---|
| 1,711,397 A | | 4/1929 | Rumble | |
| 1,811,470 A | | 6/1931 | Kraul | |
| 3,853,430 A | | 12/1974 | O'Rourke | |
| 4,128,735 A | * | 12/1978 | Zehren | H02K 5/225 174/23 R |
| 4,230,390 A | | 10/1980 | Wells | |
| 4,302,066 A | * | 11/1981 | Newman | H01R 13/6395 439/347 |
| 5,373,656 A | | 12/1994 | Merser | |

(Continued)

FOREIGN PATENT DOCUMENTS

EP 0275247 * 7/1988

OTHER PUBLICATIONS

Search Report dated May 1, 2016—S.N. PCT/US2016/013153, filed Jan. 13, 2016.

*Primary Examiner* — Charles Freay
*Assistant Examiner* — Kenneth Beyers
(74) *Attorney, Agent, or Firm* — Bracewell LLP; James E. Bradley

(57) ABSTRACT

A submersible electrical motor that drives a pump has an electrical connector receptacle base. A plug opening extends from the base into an interior of the motor and has a side wall extending around a plug opening axis. An electrical connector plug at an end of a motor lead has a nose portion that stabs into the plug opening and is surrounded by the side wall. An inward facing shoulder formed in the side wall faces inward into the motor. An outward facing shoulder on the nose portion faces outward from the motor interior and registers with the inward facing shoulder when the nose portion is fully received within the plug opening. A retainer inserts into engagement with the inward and outward facing shoulders to prevent outward movement of the plug in the plug opening. The retainer may be a pin or a ring.

12 Claims, 4 Drawing Sheets

(56) References Cited

U.S. PATENT DOCUMENTS

| | | | | |
|---|---|---|---|---|
| 5,567,170 | A * | 10/1996 | Kroeber | H01R 13/533 439/186 |
| 5,692,918 | A * | 12/1997 | Hill | G01V 1/208 174/101.5 |
| 6,056,511 | A | 5/2000 | Kennedy et al. | |
| 6,155,862 | A * | 12/2000 | Chiu | H01R 13/639 439/347 |
| 6,390,945 | B1 | 5/2002 | Young | |
| 6,409,485 | B1 | 6/2002 | Ebner | |
| 6,443,780 | B2 | 9/2002 | Wilbourn et al. | |
| 6,676,447 | B1 * | 1/2004 | Knox | H01R 13/523 439/274 |
| 6,708,037 | B1 | 3/2004 | Moulsley et al. | |
| 6,757,458 | B2 | 6/2004 | Neilson et al. | |
| 6,910,870 | B2 | 6/2005 | Ebner | |
| 7,654,315 | B2 | 2/2010 | Du et al. | |
| 7,666,013 | B1 | 2/2010 | Kopecky et al. | |
| 7,789,689 | B2 | 9/2010 | Frey et al. | |
| 8,512,074 | B2 | 8/2013 | Frey | |
| 9,000,940 | B2 * | 4/2015 | Chau | E21B 47/00 166/65.1 |
| 2004/0106320 | A1 | 6/2004 | Collin et al. | |
| 2010/0167582 | A1 * | 7/2010 | Watson | E21B 17/023 439/589 |
| 2012/0014822 | A1 | 1/2012 | Shaver et al. | |
| 2013/0008619 | A1 | 1/2013 | Katada | |
| 2013/0157487 | A1 | 6/2013 | Heebe et al. | |
| 2014/0360729 | A1 * | 12/2014 | Benestad | E21B 17/028 166/335 |

* cited by examiner

BOLTLESS ELECTRICAL CONNECTOR FOR SUBMERSIBLE WELL PUMP

FIELD OF THE DISCLOSURE

This disclosure relates in general to submersible well fluid pumps and in particular to an electrical connection between a motor lead of a power cable and a pump motor that is secured to the motor other than with bolts.

BACKGROUND OF THE DISCLOSURE

Electrical submersible pumps (ESP) are often employed to pump well fluid from wells. A typical ESP includes a rotary pump driven by an electrical motor. Normally, the ESP is suspended in the well on a string of production tubing. A seal section, usually located between the motor and the pump, has a movable element to reduce a pressure differential between the well fluid exterior of the motor and motor lubricant contained in the motor. The pump may be a centrifugal pump having a plurality of stages, each stage having an impeller and a diffuser.

ESP motors are typically supplied electrical power from a motor lead and power cable extending to the wellhead. In one type, the motor lead has a connector, often called a pothead, on its lower end. The receptacle on the motor head includes a base with a plug opening extending into the motor head. A terminal block is mounted within the plug opening. The motor lead connector or plug has a nose portion that inserts into the plug opening. Electrical terminals in the plug protrude from the plug and engage electrical terminals of the terminal block. The motor lead plug has a flange that abuts the base formed on the motor head. Screws or bolts extend through the flange into threaded holes in the base to secure the plug to the motor head.

The threaded bolt holes in the base limit the amount of cross sectional space of the plug opening, which may be circular or oblong. In some cases, more space for the electrical terminals than is available in the plug opening would be desirable. For example, with motors having higher voltage and current ratings, and/or higher temperature ratings, the limited space available in the plug and plug opening may limit the capability of the motor. Also, some motor leads and plugs have auxiliary lines, such as instrument wires or fiber optic lines, in addition to the power conductors. The auxiliary lines require additional space in the plug and plug opening.

SUMMARY

A well fluid pump assembly includes a submersible pump driven by an electrical motor. An electrical connector receptacle base on the motor has a plug opening extending inward from the base into an interior of the motor along a plug opening axis. The plug opening has a side wall extending around the axis within the interior of the motor. An electrical connector plug is configured to secure to a motor lead. The plug has a plurality of electrical terminals for delivering electrical power to the motor. The plug has a nose portion that stabs into the plug opening and is surrounded by the side wall. An inward facing shoulder is formed in the side wall and faces inward. An outward facing shoulder on the nose portion faces outward. The outward facing shoulder registers with the inward facing shoulder when the nose portion is fully received within the plug opening. A retainer inserts between and in engagement with the inward facing shoulder and the outward facing shoulder to prevent outward movement of the plug in the plug opening.

The base preferably comprises a flat surface surrounding the plug opening, the flat surface being continuous and uninterrupted. The outward facing shoulder is recessed within the plug opening when the nose portion is fully received within the plug opening. Preferably, the plug opening and the side wall are oblong relative to the plug opening axis. A seal extends around the axis and seals between the nose portion and the side wall at a point farther inward than the inward facing shoulder and the outward facing shoulder.

The outward facing shoulder on the plug is inward from the base when the plug is fully received within the plug opening. The retainer is located between the outward facing shoulder and the inward facing shoulder. The retainer is located closer to the base than the outward facing shoulder.

In the first embodiment, a pin hole extends from an exterior of the motor and intersects the side wall of the plug opening along a tangent line of the side wall, defining the inward facing shoulder. The retainer comprises a pin inserted into the pin hole into engagement with the inward facing shoulder and with the outward facing shoulder.

In a second embodiment, the pin has a conical tip portion that wedges between the inward facing shoulder and the outward facing shoulder, thereby exerting an inward directed force on the plug. In the second embodiment, one of the shoulders may be chamfered.

In a second embodiment the pin having a conical tip portion that wedges between the inward facing shoulder and the outward facing shoulder, thereby exerting an inward directed force on the plug. In the second embodiment, one of the shoulders may be chamfered.

In the third embodiment, the outward facing shoulder comprises an annular groove extending around the side wall of the plug opening. The retainer comprises a resilient retainer ring that inserts into the groove and bears against the outward facing shoulder on the plug.

BRIEF DESCRIPTION OF THE DRAWINGS

So that the manner in which the features, advantages and objects of the disclosure, as well as others which will become apparent are attained and can be understood in more detail, more particular description of the disclosure briefly summarized above may be had by reference to the embodiment thereof which is illustrated in the appended drawings, which drawings form a part of this specification. It is to be noted, however, that the drawings illustrate only a preferred embodiment of the disclosure and is therefore not to be considered limiting of its scope as the disclosure may admit to other equally effective embodiments.

DETAILED DESCRIPTION OF THE DISCLOSURE

Figure 1:
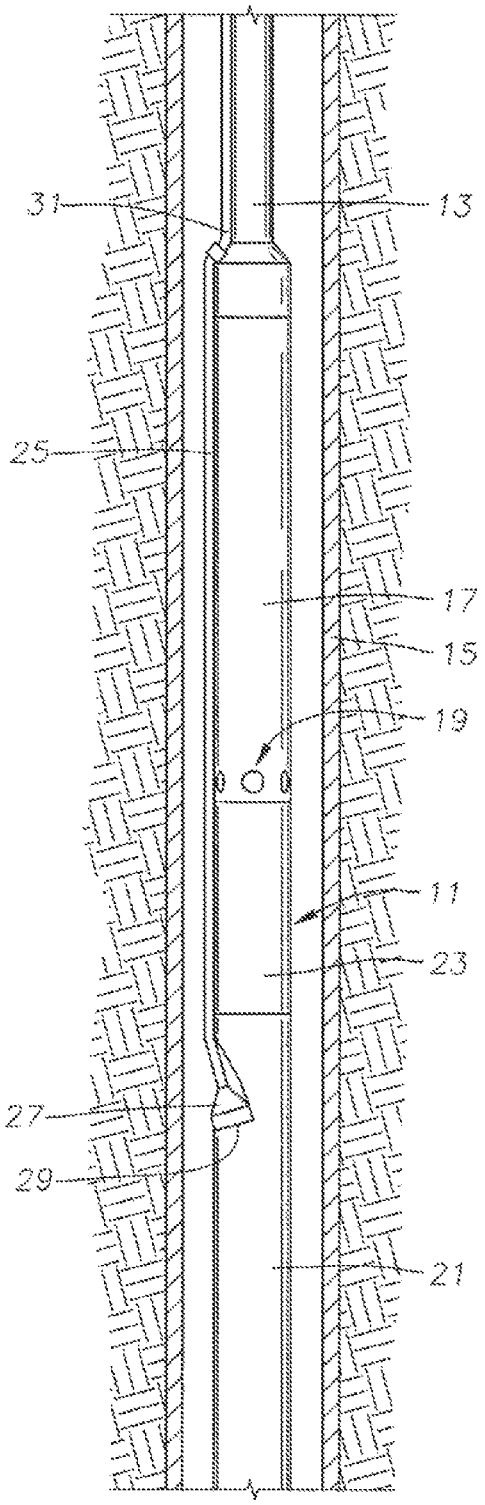
FIG. 1 is a side view of an electrical submersible pump assembly in accordance with this disclosure installed in a well.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, an electrical submersible pump (ESP) 11 is normally suspended on a string of production tubing 13 in a well having a casing 15. ESP 11 includes a pump 17, which may be a centrifugal pump having a large number of stages, each stage comprising an impeller and a diffuser. Alternately pump 17 could be another type, such as a progressing cavity pump or a reciprocating pump. Pump 17 has an intake 19 shown to be at its lower end. ESP 11 optionally could incorporate a gas separator (not shown) below pump 17; if so intake 19 would be at a lower end of the gas separator.

A motor 21 has a rotating drive shaft (not shown) that drives pump 17. Motor 21 is typically an electrical three-phase motor filled with a dielectric lubricant. A pressure equalizer or seal section 23 couples to motor 21 for reducing a pressure differential between the dielectric lubricant and hydrostatic well fluid pressure. In this example, seal section 23 has a lower end secured to motor 21 and an upper end secured to pump 17. Alternately, seal section 23 could be mounted to a lower end of motor 21. Pump 17, motor 21 and seal section 23 are secured to each other either by bolted flange connections or by internally threaded rotatable collars.

A motor lead 25 supplies electrical power to motor 21. Motor lead 25 has a plug 27 on its lower end that engages a receptacle 29 near an upper end of motor 21. Motor lead 25 forms the lower end of a power cable 31 that extends alongside production tubing 13 to a power source at the surface. Motor lead 25 is usually longer than the length of ESP 11.

Figure 2:
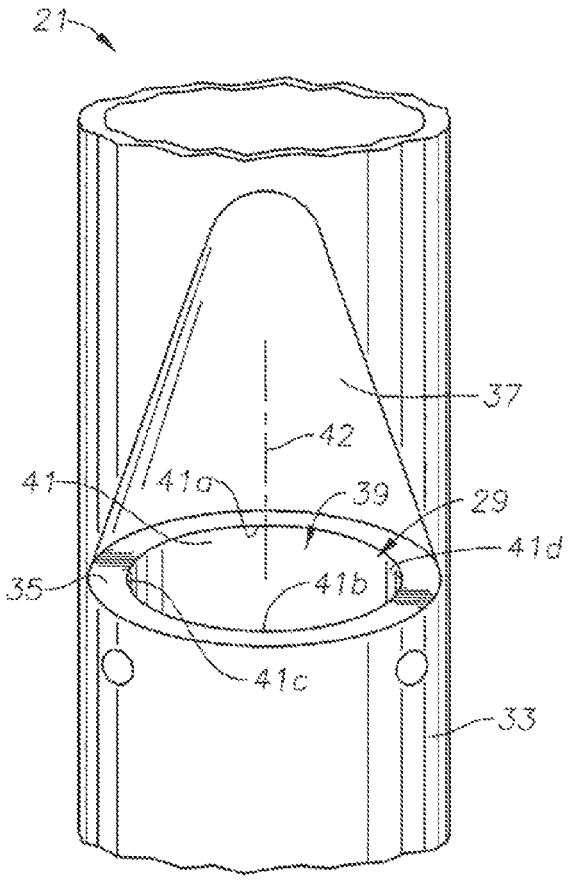
FIG. 2 is an enlarged partially sectioned perspective view of an electrical connector base of the motor of the pump assembly of FIG. 1.

Referring to FIG. 2, motor 21 includes a head 33 attached to the upper end of a housing of motor 21. Motor head 33 has a receptacle base 35, which is preferably a flat surface formed in a plane at an acute or oblique angle relative to an axis of motor 21. Base 35 is generally elliptical or oblong in configuration, and a contoured recess 37 extends upward from base 35 along motor head 33 to provide access for plug 27 (FIG. 1). The terms "upper", "lower" and the like are used herein only for convenience because ESP 11 may be installed within an inclined or horizontal portion of casing 15, rather than vertical, as shown. Also, motor 21 could be installed above pump 17 in an inverted position.

Figure 4:
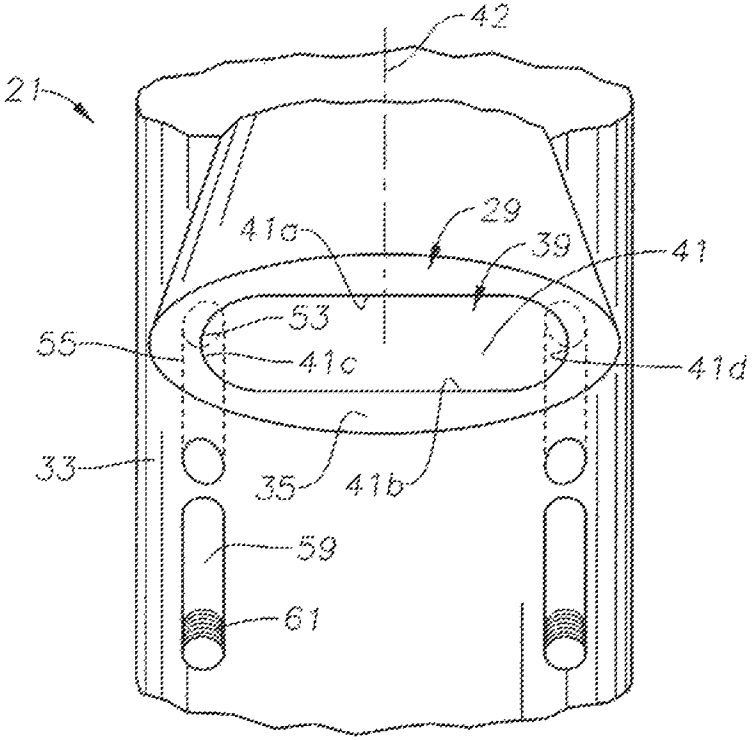
FIG. 4 is a partially sectioned top view of the electrical connector base of FIG. 2, showing retainer pins exploded.

A plug opening 39 extends from base 35 inward into the interior of motor 21. Plug opening 39 has an interior side wall 41 that extends around a plug opening axis 42. Preferably plug opening 39 and its side wall 41 are also oblong, similar to base 35, but smaller in major and minor diameters. Side wall 41 has two major diameter portions 41*a* and 41*b* that face each other. Major diameter portions 41*a*, 41*b* are joined by two minor diameter portions 41*c*, 41*d* that face each ether. Minor diameter portions 41*c*, 41*d* are curved, and if major diameter portions 41*a*, 41*b* are curved, as shown in FIG. 2, the radius of each minor diameter portion 41*c*, 41*d* is smaller than major diameter portions 41*a*, 41*b*. Major diameter portions 41*a*, 41*b* may be curved, as illustrated in FIG. 2 or generally flat and parallel as schematically illustrated in FIG. 4. Base 35 comprises a flat band or border surface located in a single plane and extending around plug opening 39 in a general configuration of a race track. Base 35 preferably is smooth and uninterrupted. There are no threaded bolt holes in base 35.

Figure 3:
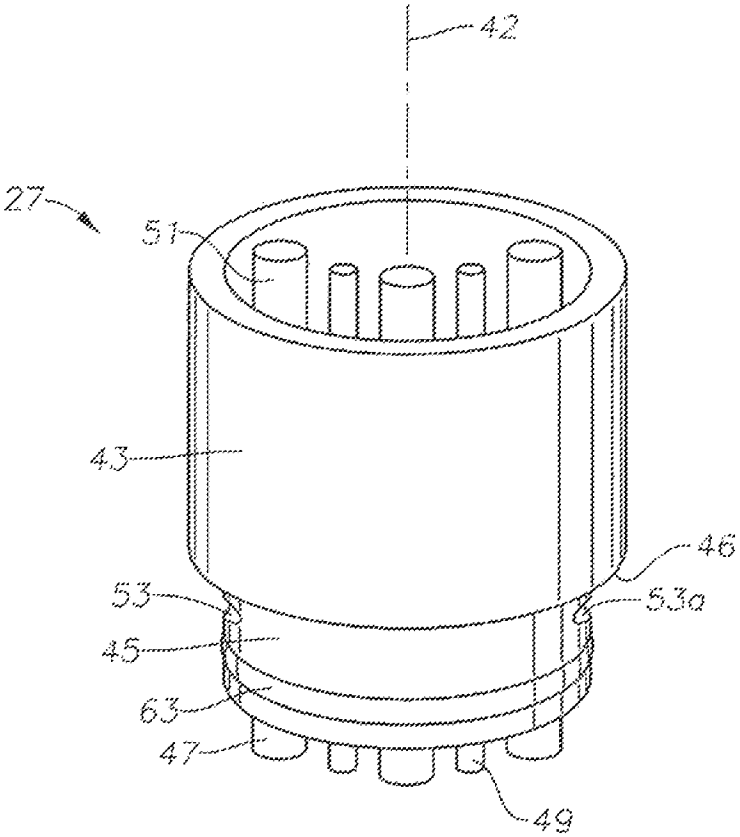
FIG. 3 is a perspective view of a first embodiment of an electrical connector that secures to the electrical connector base of FIG. 2.

Referring to FIG. 3, electrical connector or plug 27 has a body 43 that is preferably oblong in shape. A nose portion 45 extends from body 43 and may have a smaller oblong periphery than body 43, defining a shoulder 46 that faces base 35 (FIG. 2). Alternately, nose portion 45 could have the same or greater exterior dimensions as body 43. Nose portion 45 is considered to be a part of plug 27 that inserts into plug opening 39 (FIGS. 2 and 4). Electrical power terminals 47 extend from nose portion 45 for mating with terminals (not shown) within motor 21 (FIG. 2) to supply power to motor 21. Normally, there will be three electrical power terminals 47, and preferably they are positioned side by side to side to utilize as much of the oblong plug opening 39 as possible. One or more auxiliary terminals 49 (two shown) may also be located in and protrude from plug 27. Auxiliary terminals 49 may connect instrument wires, optical fibers or the like. Each terminal 47, 49 joins a separate insulated line 51 that extends up motor lead 25 (FIG. 1) to form part of power cable 31.

Figure 5:
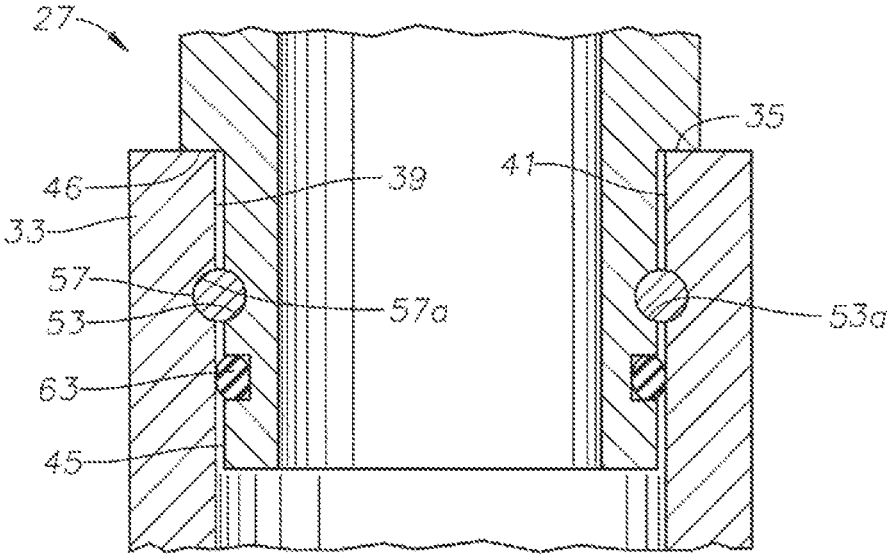
FIG. 5 is a sectional view of the electrical connector of FIG. 3, with the electrical terminals and wires removed, shown in engagement with the connector base of FIGS. 2 and 4.

In the embodiment of FIGS. 3-5, a pair of notches or grooves 53 is formed in the exterior side surface of nose portion 45. Grooves 53 are located 180 degrees from each other relative to axis 42. In this embodiment, grooves 53 do not extend completely around nose portion 45, thus do not connect with each ether. Each groove 53 has an upward facing ledge or shoulder 53*a*, which may be considered to be an outward facing shoulder because it faces outward from plug opening 39 (FIG. 4) rather than into the interior of motor 33. In this example, when viewed in a cross section along axis 42, each groove 53 is semi-circular, but other configurations are feasible, including rectangular. If semi-circular as shown in FIG. 3, each groove 53 also has a portion that may be considered to be a downward or inward facing shoulder located a short distance above outward facing shoulder 53*a*. Each groove 53 is preferably formed along a straight line.

Referring to FIG. 4, at least one and preferably two pin holes 55 are drilled into motor head 33 from the exterior. Each pin hole 55 is a straight hole formed along a line that is tangent to a surface of plug opening 39. Each pin hole 55 extends into and out of one of the minor diameter portions 41*c*, 41*d* of plug opening side wall 41, creating a pair of recesses 57, as shown in FIG. 5. Recesses 57 an opposite each other relative to axis 42, and each extends along the same straight line as one of the pin holes 55. Preferably, pin holes 55 are parallel to each other and located in a single plane that is perpendicular to axis 42. Recesses 57 have open sides that face toward axis 42.

Referring also to FIG. 5, pin holes 55 are located a distance from base 35 selected so that each will align with one of the grooves 53 when plug nose portion 45 is in a fully inserted position in plug opening 39. Each recess 57 has downward or inward facing ledge or shoulder 57*a*. The shape of each recess 57 in cross-section may be semi-circular, as shown, or rectangular. If semi-circular as shown, in the cross section of FIG. 5, each recess 57 also has an outward facing shoulder spaced slightly below inward facing shoulder 57*a*. Plug groove outward facing shoulder 53*a* is located farther from base 35 than recess inward facing shoulder 57*a* when plug 27 is in the fully inserted position. In the fully inserted position, plug shoulder 46 may be in abutment with base 35. Each recess 57 aligns with one of the grooves 53 to create a mating space between them that is generally cylindrical in the embodiment of FIG. 5.

Referring also to FIG. 4, a pin 59 inserts into each pin hole 55. Each pin 59 preferably has a threaded end to engage threads in one of the pin holes 55 near the exterior of motor head 33. Each pin 59 may have a cylindrical cross sectional shape in this embodiment. Once inserted, as illustrated in FIG. 5, a portion of each pin 59 will be in contact with one of the recesses 57 and another portion in contact with one of the grooves 53. Each pin 59 thus locates between inward facing shoulder 57*a* and an outward facing shoulder 53*a*, preventing plug 27 from being withdrawn from plug opening 39. While in the fully inserted position of FIG. 5, terminals 47 and 49 (not shown in FIG. 5) will be in mating engagement with terminals mounted in motor head 33 within plug opening 39.

The interior of motor 21 is filled with a dielectric lubricant that is in fluid communication with plug opening 39. A seal ring 63 prevents leakage of well fluid into plug opening 39. Seal ring 63 is an oblong elastomeric ring that fits within a groove extending around nose portion 45. Seal ring 63 seals to plug opening side wall 41 and is preferably located farther inward than pins 59. Consequently, it will not be necessary to seal pins 59 within pin holes 55.

Figure 6:
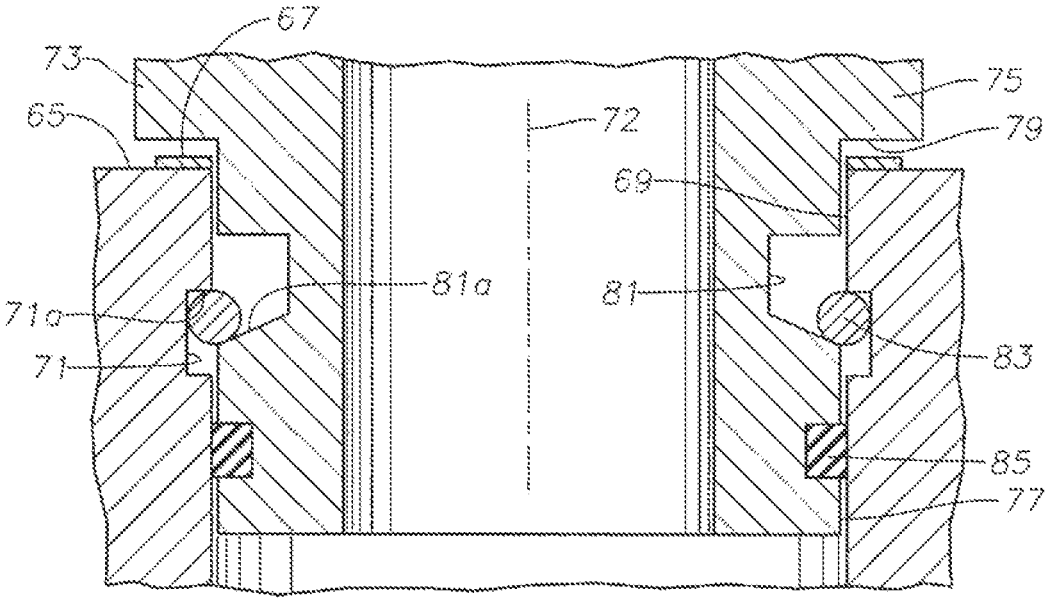
FIG. 6 is a sectional view of a second embodiment of an electrical connector and base for the pump assembly of FIG. 1, with the electrical terminals and wires removed.
Figure 7:
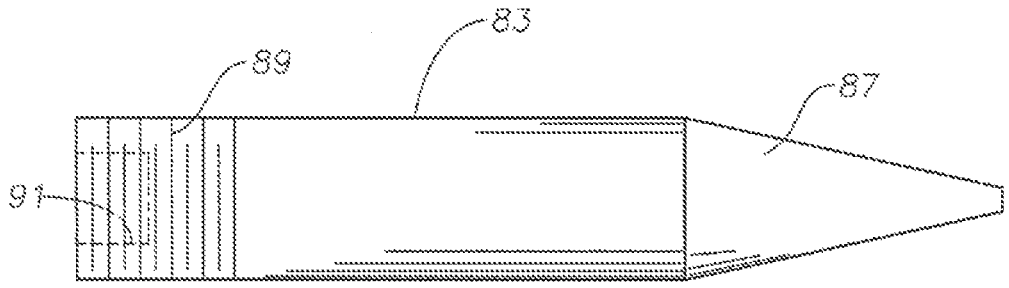
FIG. 7 is a side view of a wedging retainer pin for the electrical connector of FIG. 6.

In the embodiment of FIGS. 6 and 7, base 65 may be the same as base 35 (FIG. 4), except a gasket 67 will overlie base 65 to provide sealing at this point. A plug opening 69 extends inward from base 65. Recesses 71 are formed on opposite sides of plug opening axis 72. Each recess 71 has an inward facing shoulder 71*a*. Recesses 71 are illustrated as being rectangular in cross section, but they could be semi-circular in the same manner as recesses 57 (FIG. 5). Recesses 71 are also linear, formed along straight lines.

Plug 73 has a body 75 with a nose portion 77. Nose portion 77 has a smaller dimensioned exterior, defining an external gasket shoulder 79 that contacts gasket 67. A pair of grooves 81 is formed in the exterior of nose portion 77 on opposite sides of axis 72 and parallel to each other. In this embodiment each groove 81 has an outward facing shoulder that is in the shape of a chamfer or wedge surface 81*a*. Each chamfer 81*a* may incline inwardly from the base of groove 81 to the exterior of nose portion 77. Chamfers 81*a* may be flat and located in planes that are oblique to axis 72. When plug 73 is initially, but not fully, inserted into plug opening 69, as shown, grooves 81 will be slightly closer to base 65 than recesses 71. Plug gasket shoulder 79 will not yet be deforming gasket 67. Chamfer 81*a* will be farther inward than recess inward facing shoulder 71*a*.

A pin 83 inserts into each pin hole (not shown) to wedge plug 73 farther into plug opening 69. While being inserted, pin 83 will cause chamfer 81*a* to move further inward relative to groove inward facing shoulder 71*a*. Plug gasket shoulder 79 will deform gasket 67, causing it to form a seal between base 65 and gasket shoulder 79. A seal ring 85 may also seal between nose portion 77 and the side wall of plug opening 69 at a point inward from pins 83.

As shown in FIG. 7, pin 83 may have a conical tip portion 87 that engages chamfer 81*a*. Pin 83 may also have a threaded end 89 opposite conical tip portion 87. A drive socket 91 may be formed in the external end of threaded end 89. As pin 83 advances inward in its mating hole (not shown), conical tip portion 87 will gradually push chamfer 81*a* farther inward from groove inward facing shoulder 71*a*. This movement pulls gasket shoulder 79 tightly against gasket 67.

Figure 8:
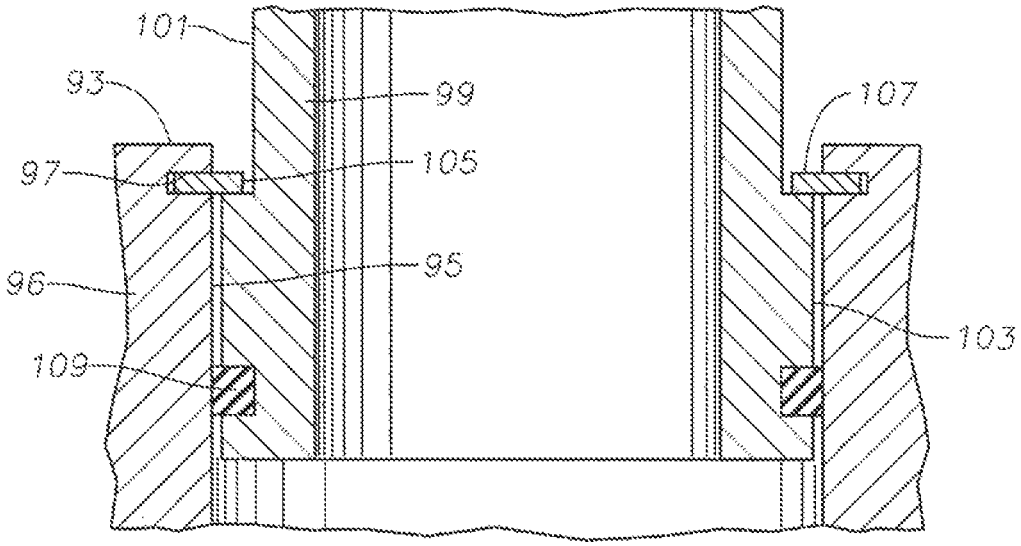
FIG. 8 is a sectional view of a third embodiment of an electrical connector and base for the pump assembly of FIG. 1, with the electrical terminals and wires removed.

Referring to FIG. 8, this embodiment does not employ pins to wedge between shoulders. Base 93 may have the same configuration as base 35 (FIG. 2) or it could of different configurations since there is no gasket that seals against base 93, unlike gasket 67 in FIG. 6. A plug opening 95 extends inward into the interior of motor bead 96. Plug opening 95 may be elliptical or oblong as in the other embodiments. An annular groove 97 extends around the side wall of plug opening 95. Groove 97 is spaced a short distance inward from base 93, and in this example, has inward and outward facing shoulders that are parallel to each other.

Plug 99 has a body 101 and a nose portion 103. Nose portion 103 has a larger periphery than body 101, defining an outward facing shoulder 105. A retaining ring 107 snaps into groove 97 and overlies shoulder 105 to prevent plug 99 from being withdrawn from plug opening 95. Retaining ring 107 is a resilient a split snap ring with an oblong configuration. A larger diameter portion of retaining ring 107 locates in groove 97 and a smaller diameter portion of retaining ring 107 contacts outward facing shoulder 105. A seal ring 109 fits in a seal groove extending around nose portion 103 and seals against the side wall of plug opening 95. Seal ring 109 is located farther in plug opening 95 than retainer ring groove 97. When plug 99 is in the fully inserted position, as in FIG. 8, shoulder 105 will be recessed a short distance within plug opening 95.

While the disclosure has been shown in only a few of its forms, it should be apparent to those skilled in the art that it is susceptible to various modifications.

The invention claimed is:

1. A well fluid pump assembly, comprising:

a submersible pump driven by an electrical motor;

an electrical connector receptacle base surface on the motor;

a plug opening extending inward from the base surface into an interior of the motor along a plug opening axis, the plug opening having a side wall extending around the axis within the interior of the motor, the side wall having an oblong configuration with two major diameter portions facing each other joined by two minor diameter portions facing each other, the minor diameter portions having shorter lengths than the major diameter portions;

an electrical connector plug secured to a motor lead, the plug having a plurality of electrical terminals for delivering electrical power to the motor, the plug having a plug body with a nose portion that stabs into the plug opening and is surrounded by the side wall, the nose portion having an oblong configuration that mates with the oblong configuration of the side wall and has two major diameter portions facing away from each other joined by two minor diameter portions facing away from each other, the minor diameter portions of the nose portion having shorter lengths than the major diameter portions of the nose portion;

a pair of plug opening grooves, each of the plug opening grooves being formed in one of the minor diameter portions of the side wall, the plug opening grooves being straight and parallel to each other;

a pair of nose portion grooves, each of the nose portion grooves being formed in one of the minor diameter portions of the nose portion, the nose portion grooves being straight and parallel to each other, each of the nose portion grooves registering with one of the plug opening grooves when the nose portion is fully received within the plug opening;

a pair of pin holes, each of the pin holes extending from an exterior of the motor and joining one of the plug opening grooves; and a pair of pins, each of the pins inserted into one of the pin holes and into engagement with one of the plug opening grooves and one of the nose portion grooves to prevent outward movement of the plug in the plug opening away from the interior of the motor.

2. The assembly according to claim 1, wherein the pin holes have threads, and the pins have threads that secure to the threads of the pin holes.

3. The assembly according to claim 1, wherein:

each of the pins has a cylindrical portion and a conical tip; and the insertion of each of the pins into the pins holes causes the conical tips to wedge the nose portion grooves into alignment with the plug opening grooves.

4. The assembly according to claim 1, wherein the plug body and the nose portion are formed of a single piece of material.

5. The assembly according to claim 1, further comprising:

a seal extending around the axis and sealing between the nose portion and the side wall, the seal being inward toward the interior of the motor from the plug opening grooves and the nose portion grooves.

6. The assembly according to claim 1, further comprising:

a gasket shoulder at a junction between the nose portion and the plug body that faces the base surface; and a gasket between the gasket shoulder and the base surface, the gasket forming a seal between the gasket shoulder and the base surface in response to insertion of the pins into the plug opening grooves and the nose portion grooves.

7. A well fluid pump assembly, comprising:

a submersible pump driven by an electrical motor;

an electrical connector receptacle base surface on the motor;

a plug opening extending inward from the base surface into an interior of the motor along a plug opening axis, the plug opening having a side wall extending around the axis within the interior of the motor, the side wall having an oblong configuration with two major diameter portions facing each other joined by two minor diameter portions facing each other, the minor diameter portions having shorter lengths than the major diameter portions;

an electrical connector plug secured to a motor lead, the plug having a plurality of electrical terminals for delivering electrical power to the motor, the plug having a plug body with a nose portion that stabs into the plug opening and is surrounded by the side wall, the nose portion having an oblong configuration that mates with the oblong configuration of the side wall and has two major diameter portions facing away from each other joined by two minor diameter portions facing away from each other, the minor diameter portions of the nose portion having shorter lengths than the major diameter portions of the nose portion;

a pair of pin holes extending from an exterior of the motor, each of the pin holes joining one of the minor diameter portions of the side wall along a straight line tangent to said one of the minor diameter portions of the side wall to define a recess in said one of the minor diameter portions of the side wall that is open toward the axis, each of the pin holes having a set of threads at the exterior of the motor;

a pair of grooves formed on the nose portion of the plug, each of the grooves being formed in one of the minor diameter portions of the nose portion each of the grooves aligning with one of the recesses when the nose portion is in a fully inserted position in the plug opening;

a pair of pins, each of the pins being inserted through one of the pin holes into engagement with one of the recesses and one of the grooves when the nose portion is in the fully inserted position to retain the plug; wherein each of the pins has a cylindrical body with threads on one end that secure to the threads in one of the pin holes in response to rotation of the cylindrical body; and each of the pins has a conical tip protruding from the cylindrical body, the conical tips wedging each of the grooves into alignment with one of the recesses as the cylindrical body is rotated.

8. The assembly according to claim 7, wherein each of the grooves extends along a straight line that coincides with the straight line of one of the pin holes.

9. The assembly according to claim 7, further comprising:

a gasket shoulder on the plug that faces toward the base surface;

a gasket located between the gasket shoulder and the base surface; and wherein the conical portion of each of the pins creates an inward directed force on the plug to deform the gasket between the gasket shoulder and the base as the pins are rotated in the pin holes.

10. The assembly according to claim 7, further comprising:

a seal extending around the axis and sealing between the nose portion and the side wall, the seal being located farther into the interior of the motor than the recesses and the grooves.

11. A well fluid pump assembly, comprising:

a submersible pump driven by an electrical motor;

an electrical connector having a plug opening extending into an interior of the motor along a plug opening axis, the plug opening having a side wall extending around the axis within the interior of the motor, the side wall having an elliptical configuration;

a groove formed in the side wall and extending completely around the axis, the groove having an elliptical configuration;

an electrical connector plug secured to a motor lead, the plug having a plurality of electrical terminals for delivering electrical power to the motor, the plug having a plug body with a nose portion having an elliptical configuration that stabs into the plug opening and is surrounded by the side wall;

an outward facing shoulder on and extending around the nose portion, the outward facing shoulder facing outward from the interior of the motor and being recessed within the plug opening; and a retaining ring having an elliptical configuration, the retaining ring a larger diameter portion inserted into the groove and a smaller diameter portion overlying and engaging the outward facing shoulder.

12. The assembly according to claim 11, further comprising:

a seal ring extending around the nose portion and in sealing engagement with the side wall at a point farther in the interior of the motor than the groove.

* * * * *